US005197456A

United States Patent [19]

Ryno

[11] Patent Number: 5,197,456

[45] Date of Patent: Mar. 30, 1993

[54] GAS WATER HEATER WITH IMPROVED EXHAUST DISTRIBUTION IN MULTIPLE FLUES

[75] Inventor: Robert W. Ryno, El Paso, Tex.

[73] Assignee: AOS Holding Company, Wilmington, Del.

[21] Appl. No.: 720,342

[22] Filed: Jun. 25, 1991

[51] Int. Cl.[5] ..... F24H 1/00

[52] U.S. Cl. ..... 126/350 R; 126/344; 126/390; 126/391

[58] Field of Search ..... 126/350 R, 110 R, 99 D, 126/344, 390, 391-392; 122/494; 431/8

[56] References Cited

U.S. PATENT DOCUMENTS

| | | | |
|---|---|---|---|
| 263,198 | 8/1882 | Mundell et al. . | |
| 1,303,924 | 5/1919 | Latham | 110/322 |
| 1,423,346 | 7/1922 | McGahan . | |
| 1,949,726 | 3/1934 | McKee . | |
| 2,465,712 | 3/1949 | Clarkson | 126/350 R |
| 4,257,355 | 3/1981 | Cook . | |
| 4,509,435 | 4/1985 | Adams . | |
| 4,978,293 | 12/1990 | Ryno . | |

*Primary Examiner*—Larry Jones

*Attorney, Agent, or Firm*—David R. Price; James Earl Lowe, Jr.

[57] ABSTRACT

A water heater comprising a tank defining a water chamber, a generally cylindrical combustion chamber located beneath the water chamber and centered on a generally vertical axis, a plurality of flues communicating with the combustion chamber and extending through the water chamber, and a single power burner for directing a flame into the combustion chamber. The power burner includes a nozzle centered on a generally horizontal axis intersecting the chamber axis. A flame deflector made of a refractory material is located in the combustion chamber. The flame deflector has a substantially hemispherical upper portion and a generally cylindrical lower portion centered on a common, generally vertical axis.

19 Claims, 1 Drawing Sheet

GAS WATER HEATER WITH IMPROVED EXHAUST DISTRIBUTION IN MULTIPLE FLUES

BACKGROUND OF THE INVENTION

The invention relates to multiple flue water heaters, and more particularly to commercial water heaters with power gas burners.

A commercial water heater typically has a plurality of flues communicating with the combustion chamber. See, for example, U.S. Pat. No. 4,257,335, which is assigned to the assignee hereof. It is known to provide a commercial water heater with a power gas burner, such as the power gas burner disclosed in U.S. Pat. No. 4,978,293, which is assigned to the assignee hereof and which is incorporated herein by reference.

SUMMARY OF THE INVENTION

It has been found that the flow of gases through the flues of a commercial water heater can be uneven and can therefore reduce efficiency. The invention provides a flame deflector that is located in the combustion chamber of a water heater and that provides a substantially even flow of gases through the flues.

More particularly, the invention provides a commercial water heater comprising a tank defining a water chamber, and a generally cylindrical combustion chamber located beneath the water chamber and centered on a generally vertical axis. The water heater also comprises a plurality of flues communicating with the combustion chamber and extending upwardly through the water chamber, and a single power burner for directing a flame into the combustion chamber. The power burner includes a nozzle centered on a generally horizontal axis intersecting the chamber axis. In other words, the power burner directs the flame radially inwardly into the combustion chamber.

The water heater further comprises a flame deflector located in the combustion chamber. The flame deflector is made of refractory material and has a cylindrical lower portion and a hemispherical upper portion. The flame deflector is centered on a generally vertical axis that is spaced from the combustion chamber axis in the direction away from the power burner. Thus, the chamber axis is located between the deflector axis and the power burner. The upper end of the flame deflector is located slightly beneath the nozzle axis.

This flame deflector location and construction has been found to direct burning gases upwardly and to the sides of the combustion chamber to provide a substantially balanced flow through the flues of the water heater. Without the flame deflector, measurements of air flow through the individual flues demonstrated that air velocities varied from 10% to 120% of the average flow. The most efficient heat transfer occurs with balanced flue velocities. The result of using the deflector is more uniform flue velocities and therefore higher efficiency. The deflector also prevents the long burner flame from impinging directly on the opposite wall of the combustion chamber, and provides a desirable back pressure to the burner.

Other features and advantages of the invention will become apparent to those skilled in the art upon review of the following detailed description, claims and drawings.

Figure 1:
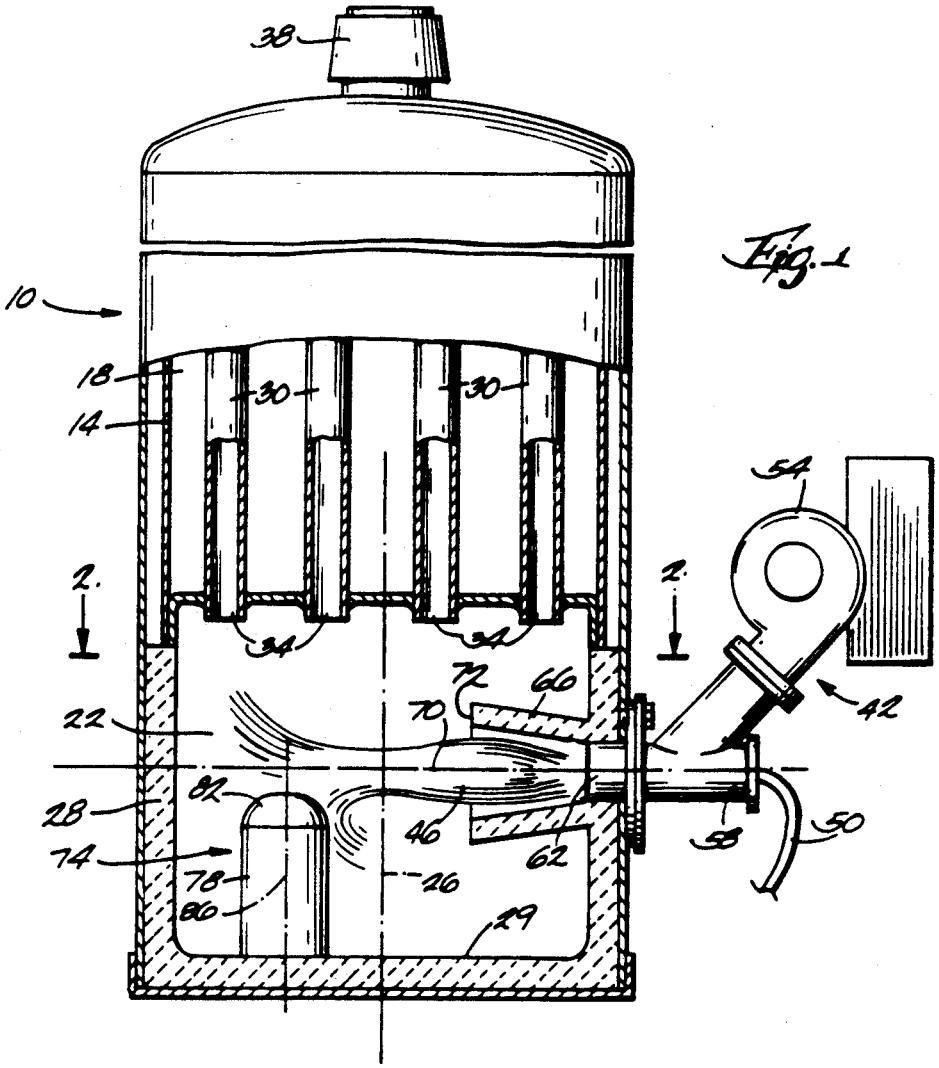
FIG. 1 is an elevational view, partially in section, of a water heater embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A water heater 10 embodying the invention is illustrated in the drawings. The water heater 10 comprises a tank 14 defining a water chamber 18. The water chamber 18 has inlet and outlet means (not shown) for introducing cold water and removing heated water, respectively.

The water heater 10 also comprises a generally cylindrical combustion chamber 22 located beneath the water chamber 18 and centered on a generally vertical axis 26. The combustion chamber 22 is formed by a heat tolerant tub or liner 28 made of a refractory material. The liner 28 has an upwardly facing inner surface or floor 29. A plurality of flues 30 open at their lower ends 34 to the top of the combustion chamber 22, and the flues 30 extend vertically upward through the water chamber 18. The flues 30 are elongated cylinders or tubes, preferably of a material highly conductive of heat, and are distributed evenly throughout the water chamber 18. In the preferred arrangement sixteen flues are used, with four inner flues in the center of the chamber 18 circled by twelve outer flues. The flues 30 conduct the gases of combustion away from the combustion chamber 22, and while doing so pass the heat of those gases to the water in the water chamber 18. The flues 30 have ends (not shown) in communication with an outlet 38 at the top of the tank 14.

The water heater 10 also comprises a single power burner 42 for directing a flame 46 into the combustion chamber. The power burner 42 is depicted somewhat schematically in the drawings, but is substantially identical to the one disclosed in U.S. Pat. No. 4,978,293, assigned to the assignee hereof. In the preferred embodiment, a flame retention plate, such as disclosed in U.S. patent application, Ser. No. 07/540,079 filed Jun. 19, 1990, is used in the power burner.

A gas line 50 conducts gas to the power burner 42. The power burner 42 has a blower 54 external the tank 14. The blower 54 directs air through an air tube 58, which extends into the combustion chamber 22. At the inner end of the air tube 58 is a burner head assembly 62, which is internal to the combustion chamber 22. The burner head assembly 62 is surrounded by a nozzle 66, preferably of a refractory material. The nozzle 66 is centered on a generally horizontal axis 70, and extends radially of the combustion chamber 22. The nozzle 66 has an inner end or face 72 and is slightly conical, flaring towards its face 72. The nozzle axis 70 intersects the vertical axis 26 of the combustion chamber 22 or, in other words, the nozzle 66 directs the flame 46 radially inwardly into the combustion chamber 22. At the burner head assembly 62, air is combined with gas and the mixture ignited. The resultant flame 46 is pushed horizontally by forced air from the blower 54, and extends away from the burner head assembly 62 and is directed through the nozzle 66 into the combustion chamber 22.

Figure 2:
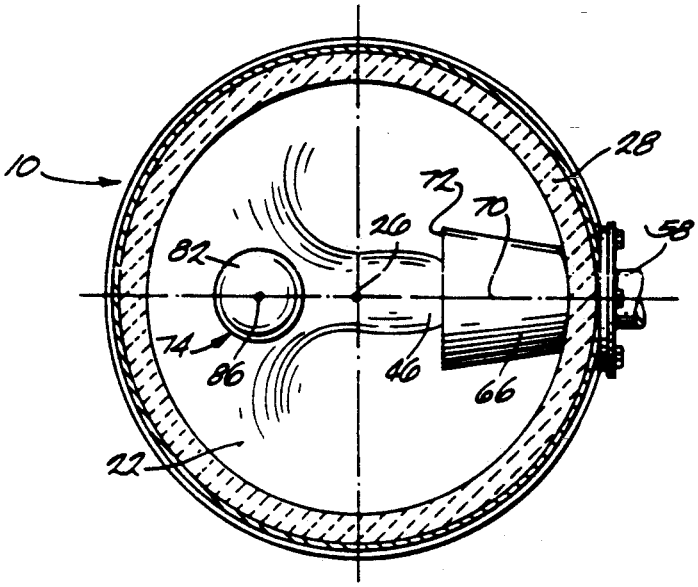
FIG. 2 is a view taken along line 2—2 in FIG. 1.

The water heater 10 also comprises a flame deflector 74 located in the combustion chamber 22. The flame deflector 74 is made of a refractory material. The flame deflector 74 has a generally cylindrical lower portion 78 and a substantially hemispherical upper portion 82. The upper end or top of the hemispherical upper portion 82 is located just slightly beneath the nozzle axis 70 (FIG. 1). The hemispherical upper portion 82 and the cylindrical lower portion 78 of the flame deflector 74 are centered on a common, generally vertical axis 86 that is spaced from the axis 26 of the combustion chamber 22 in the direction away from the nozzle 66 (FIG. 2). The flame deflector 74 is thus located within the combustion chamber 22 such that the deflector axis 86 intersects the horizontal axis 70 of the nozzle 66, and the chamber axis 26 is located between or intermediate the deflector axis 86 and the nozzle 66.

The flame deflector 74, the nozzle 66 and the combustion chamber liner 28 preferably are of unitary construction and are made of silica base PYROLITE, as is available from RexRoto Corporation of Walled Lake, Mich. The PYROLITE used in the nozzle 66 and flame deflector 74 is preferably ½ inch thick and rated to withstand 2,600 degrees Fahrenheit, whereas the PYROLITE used for the liner 28 is preferably one and ½ inches thick and rated to withstand 2,300 degrees Fahrenheit. The whole combustion chamber 22 becomes radiant in operation.

In the preferred embodiment the combustion chamber 22 has an inner diameter of approximately twenty and ⅝ inches, and a height from the floor 29 to the top of the liner 28 of twenty one and ½ inches. The flame deflector 74 has a height of eight and ½ inches from the floor 29 to the top of the hemispherical portion 86. The top of the hemispherical portion 86 falls approximately ½ inch below the nozzle axis 70. The outer diameter of the lower portion 82 of the flame deflector 74 is approximately 4 inches. Preferably, the flame reflector 74 is hollow. The height of the lower portion 78 is six and 15/16 inches, and the height of the upper portion 82 is one and 9/16 inches. The flame deflector axis 86 is preferably positioned approximately two and 3/16 inches from the axis 26. The nozzle 66 is flush with the inside wall of the combustion chamber 22. The face 72 of the nozzle 66 is approximately twelve and ½ inches from the flame deflector axis 86, and ten and 5/16 inches from the combustion chamber axis 26.

The hemispherical portion 82 is slightly cut off or abbreviated at the sides, the curvature of the dome corresponding to a radius of approximately two and 3/32 inches, while, as mentioned previously, the hemispherical portion 82 has an actual height of only one and 9/16 inches. This gives the hemispherical portion 82 a slightly flattened appearance. The generally hemispherical portion 82 of the flame deflector 74 forms a dome, and this deflects the flame 46. It also prevents the flame 46 from impinging directly on the rear wall of the combustion chamber 22, while providing desirable back pressure to the burner 42. The deflector height, dome configuration, diameter and distance from the burner are all important in making the flame deflector 74 work effectively in a given combustion chamber. It should be understood that these dimensions can be different in other embodiments of the invention.

The gases of combustion, as previously mentioned, are directed by the hemispherical portion 82 in varied directions. As the gases are directed both upwardly and to the sides of the combustion chamber 22, this results in a balanced flow through the flues 30 by more evenly distributing the loading of the flues 30. The result is more uniform flue temperature loading and therefore higher efficiency for the water heater 10. The use of the illustrated and described flame deflector 74 has thus been found to increase the efficiency of a conventional commercial water heater from 75 percent to in excess of 80 percent.

Various features of the invention are set forth in the following claims.

I claim:

1. A water heater comprising a tank defining a water chamber, a combustion chamber located beneath said water chamber, a plurality of flues communicating with said combustion chamber and extending through said water chamber, a power burner for directing a flame into said combustion chamber, and a flame deflector which is located in said combustion chamber and which has a substantially hemispherical upper portion.

2. A water heater as set forth in claim 1 wherein said flame deflector has a generally cylindrical lower portion.

3. A water heater as set forth in claim 2 wherein said hemispherical upper portion and said cylindrical lower portion are centered on a common, generally vertical axis.

4. A water heater as set forth in claim 1 wherein said power burner includes a nozzle centered on a generally horizontal axis, and wherein said deflector has an upper end located beneath said axis.

5. A water heater as set forth in claim 4 wherein said combustion chamber is generally cylindrical, and wherein said nozzle axis extends radially of said combustion chamber.

6. A water heater as set forth in claim 5 wherein said deflector has a generally vertical axis intersecting said nozzle axis.

7. A water heater as set forth in claim 6 wherein said combustion chamber is centered on a generally vertical axis, and wherein said deflector axis is spaced from said combustion chamber axis.

8. A water heater as set forth in claim 7 wherein said combustion chamber axis is located intermediate said deflector axis and said nozzle.

9. A water heater comprising a tank defining a water chamber, a combustion chamber located beneath said water chamber, a plurality of flues communicating with said combustion chamber and extending through said water chamber, a power burner for directing a flame into said combustion chamber, said power burner including a nozzle centered on a generally horizontal axis, and a flame deflector which is located in said combustion chamber and which has an upper end located beneath said axis.

10. A water heater as set forth in claim 9 wherein said combustion chamber is generally cylindrical, and wherein said nozzle axis extends radially of said combustion chamber.

11. A water heater as set forth in claim 10 wherein said deflector has a generally vertical axis intersecting said nozzle axis.

12. A water heater as set forth in claim 11 wherein said combustion chamber is centered on a generally vertical axis, and wherein said deflector axis is spaced from said combustion chamber axis.

13. A water heater as set forth in claim 12 wherein said combustion chamber axis is located intermediate said deflector axis and said nozzle.

14. A water heater as set forth in claim 9 wherein said water heater comprises only one power burner.

15. A water heater comprising a tank defining a water chamber, a generally cylindrical combustion chamber located beneath said water chamber and centered on a generally vertical axis, a plurality of flues communicating with said combustion chamber and extending through said water chamber, a power burner for directing a flame into said combustion chamber, and a flame deflector which is located in said combustion chamber and which has a generally vertical axis spaced from said combustion chamber axis.

16. A water heater as set forth in claim 15 wherein said power burner includes a nozzle centered on a generally horizontal axis intersecting said chamber axis.

17. A water heater as set forth in claim 16 wherein said deflector axis intersects said nozzle axis.

18. A water heater as set forth in claim 17 wherein said combustion chamber axis is located intermediate said deflector axis and said nozzle.

19. A water heater as set forth in claim 15 wherein said water heater comprises only one power burner.

* * * * *